US006814235B2

(12) United States Patent
Wang

(10) Patent No.: US 6,814,235 B2
(45) Date of Patent: Nov. 9, 2004

(54) SERVING TRAY

(75) Inventor: Tin-Chou Wang, Tainan Hsien (TW)

(73) Assignee: Hwan Yih Enterprise Co., Ltd., Taipei Hsien (TW)

( * ) Notice: Subject to any disclaimer, the term of this patent is extended or adjusted under 35 U.S.C. 154(b) by 135 days.

(21) Appl. No.: 10/351,373

(22) Filed: Jan. 27, 2003

(65) Prior Publication Data

US 2004/0144683 A1 Jul. 29, 2004

(51) Int. Cl.[7] ..... B65D 1/34; B65D 1/48

(52) U.S. Cl. ..... 206/557; 206/524.3; 206/565; 220/574; 264/273

(58) Field of Search ..... 206/557–567, 206/524.3, 524.6; D7/545; 220/676, 671, 574, 23.83; 264/247, 250, 273, 275

(56) References Cited

U.S. PATENT DOCUMENTS 2,777,626 A * 1/1957 French ..... 229/406
3,637,454 A * 1/1972 Pavernick ..... 428/71
3,937,389 A * 2/1976 Wind ..... 229/406
4,183,435 A * 1/1980 Thompson et al. ..... 206/557
4,737,390 A * 4/1988 Fricano et al. ..... 428/34.2
4,744,597 A * 5/1988 Bauman et al. ..... 294/172
D316,210 S * 4/1991 Giugiaro ..... D7/545
5,137,248 A * 8/1992 Sato et al. ..... 248/634
5,169,023 A * 12/1992 Heiberg et al. ..... 220/574
6,330,956 B1 * 12/2001 Willinger ..... 220/574
D472,767 S * 4/2003 Gebhardt et al. ..... D7/552.1

* cited by examiner

*Primary Examiner*—Derris H. Banks
*Assistant Examiner*—Dmitry Suhol
(74) *Attorney, Agent, or Firm*—Rosenberg, Klein & Lee

(57) ABSTRACT

A serving tray includes a holding portion, and handles at two sides of the holding portion; the holding portion has trenches formed on an upper side, recesses formed on a bottom, a through hole, upper flow passages formed on the upper side, and lower flow passages formed on the bottom; the handles have second recesses formed thereon. Slip-prevention rubber sheets are attached to the trenches and the recesses by means of injecting melted rubber into a mold used for making the holding portion and the handles via the through hole for the melted rubber to be applied over the trenches, and the recesses via the upper and the lower flow passages.

3 Claims, 5 Drawing Sheets

SERVING TRAY

BACKGROUND OF THE INVENTION

1. Field of the Invention

The present invention relates to a serving tray, more particularly one, which has rubber sheets attached to an upper side thereof for preventing objects held on the upper side from slipping, and has rubber sheets attached to a bottom, and handles thereof for reducing slipperiness of the same respectively.

2. Brief Description of the Prior Art

Referring to FIG. 9, a conventional serving tray 4 has a sheet of rubber 42 attached to a holding portion 41 thereof by means of adhesive, which is cut into the shape of the holding portion 41, after the tray 4 has been formed by means of injection molding. The main function of the rubber 42 is to prevent objects held on the holding portion 41 such as bottles, wine glasses, dishes etc from slipping when the serving tray 4 is being used.

However, such serving tray is found to have disadvantages as followings:

1. The adhesive is likely to lose the adhesion to both the rubber 4 and the holding portion 41 after the serving tray 4 has been used for a long period, and in turn, the rubber 42 will fall off or form undesirable raised portions to reduce stability of objects that are held on the tray 4.
2. Material cost of the serving tray 4 is very high because rubber is relatively expensive as compared with plastic and because rubber attached to the tray 4 is relatively big, covering the whole holding portion 41. Consequently, the serving tray 4 is not competitive.

SUMMARY OF THE INVENTION

It is an object of the present invention to provide a serving tray, which has slip-prevention rubber sheets attached to it in a relatively convenient and cost-saving way by means of an injection molding machine.

It is another object of the present invention to provide slip-prevention rubber sheets to a serving tray, which are so firmly attached to the serving tray as to not easily fall off.

The serving tray of the present invention has trenches and flow passages on upper and lower sides of a holding portion thereof, and recesses at handles thereof. After the handles and the holding portion are made with an injection machine and harden in the mold, slip-prevention rubber sheets are attached to the trenches and the recesses by means of injecting melted rubber into the mold via the through hole for the melted rubber to be applied over the trenches, and the recesses via the upper and the lower flow passages.

BRIEF DESCRIPTION OF THE DRAWINGS

The present invention will be better understood by reference to the accompanying drawings, wherein.

DETAILED DESCRIPTION OF THE PREFERRED EMBODIMENTS

Figure 1:
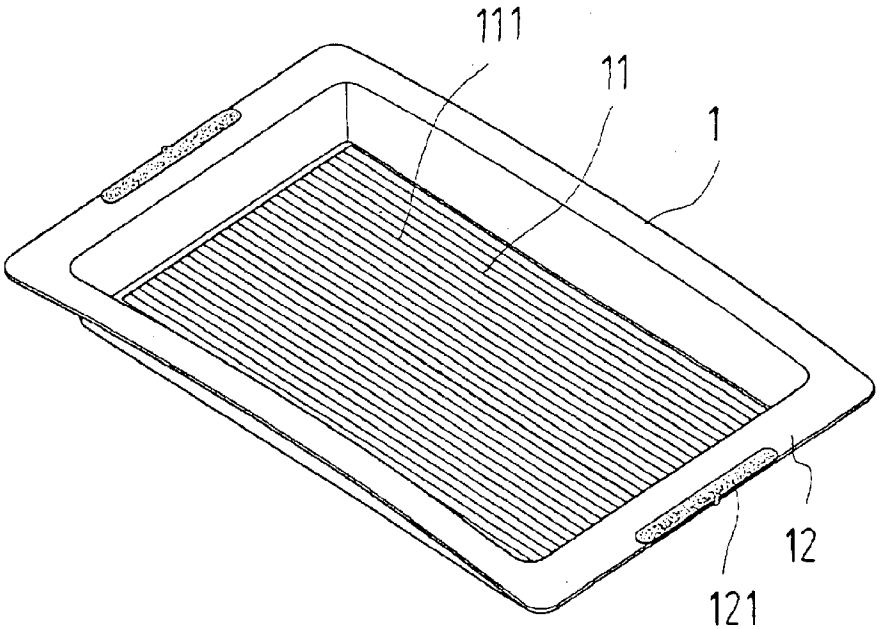
FIG. 1 is a perspective view of the serving tray according to the present invention.
Figure 9:
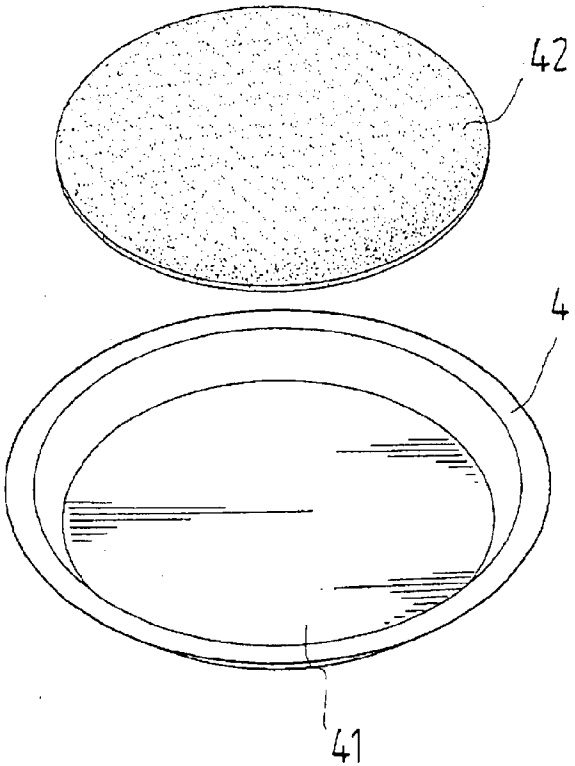
FIG. 9 (PRIOR ART)
Figure 3:
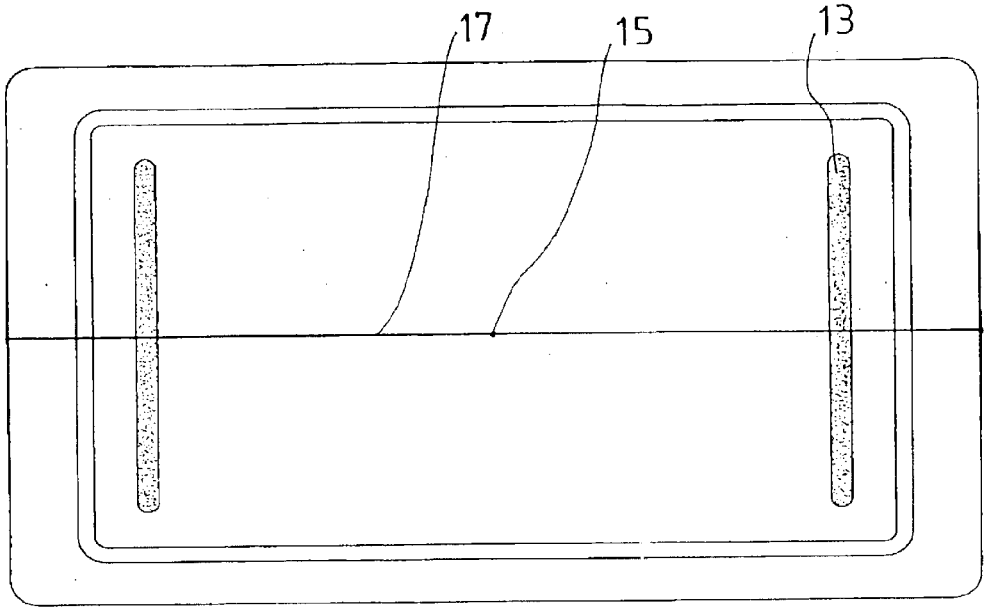
FIG. 3 is a bottom view of the serving tray according to the present invention.
Figure 2:
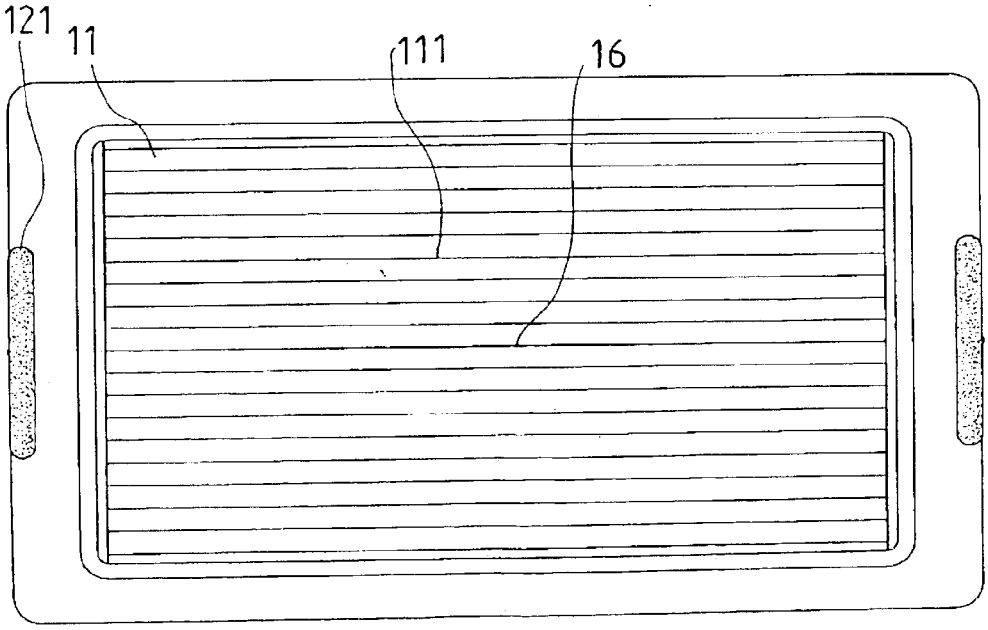
FIG. 2 is a vertical view of the serving tray according to the present invention.

Referring to FIGS. 1, 2, and 3, a serving tray 1 of the first embodiment of the present invention has a main body including a holding portion 11, and handles 12 at two opposite edges thereof, and has rubbers 111, 121, and 13 respectively attached to the holding portion 11, the handles 12, and a bottom thereof.

Rubbers 111 are each made in the shape of a long and narrow sheet, and are spaced apart on the holding portion 11 for preventing objects held on the holding portions 11, e.g. bottles, wine glasses, and dishes, from slipping.

Rubbers 121 are each made in the form of a sheet, and are attached to both an upper side and a lower side of respective handles 12 for reducing slipperiness of the handles 12, thus preventing the tray 1 from slipping while being held by a user.

Rubbers 13 are provided for preventing the serving tray 1 from slipping and wearing, and are preferably made in the form of long and narrow sheets.

Figure 4:
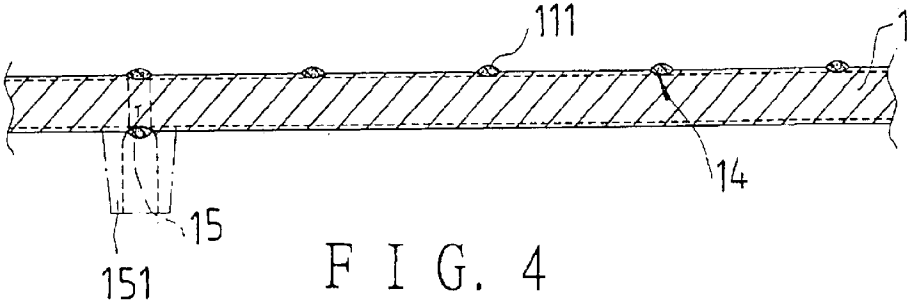
FIG. 4 is a partial cross-sectional view of the serving tray according to the present invention.
Figure 5:
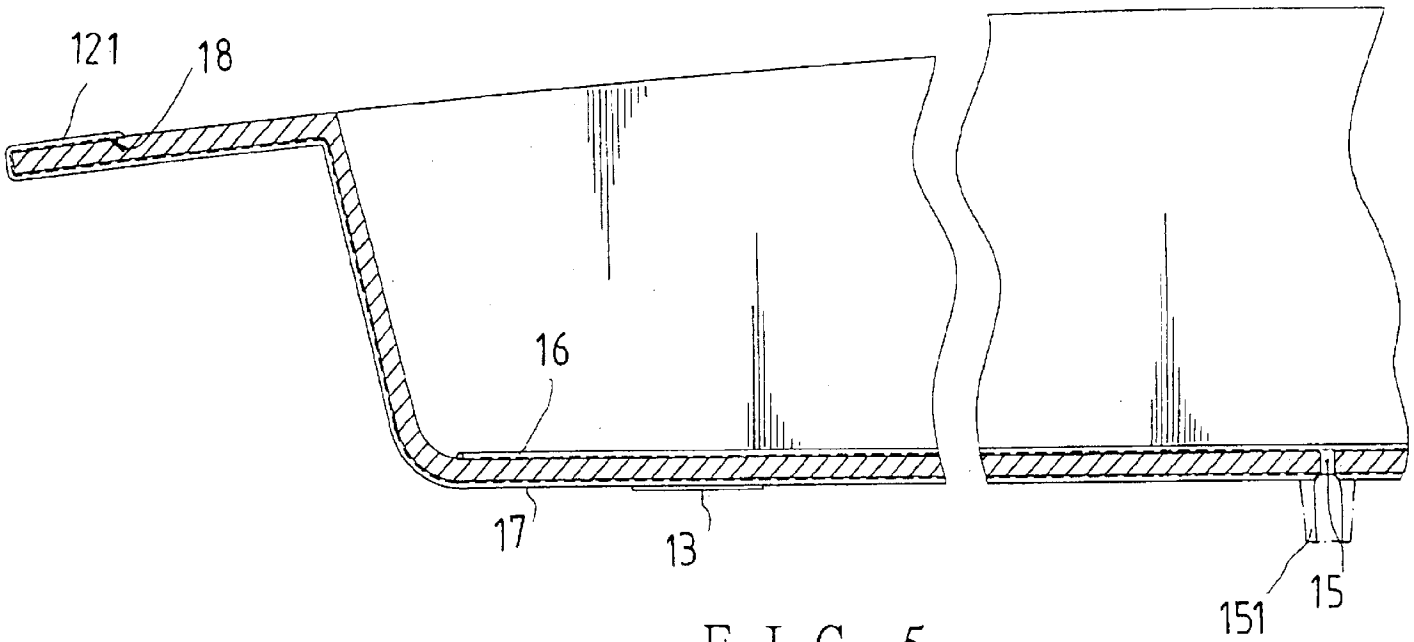
FIG. 5 is another partial cross-sectional view of the serving tray according to the present invention.

Referring to FIGS. 4, and 5, serving tray 1 is made of plastic, and formed by means of a bicolor injection molding machine; the serving tray 1 is formed with several spaced trenches 14 on a holding portion 11 thereof, recesses 18 on handles 12 and a bottom thereof, a through hole 15 on the holding portion 11, a short tube 151 around the through hole 15, upper flow passages 16 on the upper side and in communication with the through hole 15 as well as the trenches 14, and lower flow passages 17 on the lower side and in communication with the through hole 15 as well as the recesses 18; after the serving tray 1 is made and hardens in the mold of the bicolor injection molding machine, melted rubber is injected into the mold via both the through hole 15 and the short tube 151 of the tray 1; thus, the melted rubber is forced to flow along the upper and the lower flow passages 16, 17 onto the trenches 14, and the recesses 18 respectively. Therefore, long and narrow sheets of rubbers 111 are attached to the trenches 14, capable of preventing objects held on the holding portions 11 from slipping while sheets of rubbers 121, and 13 are respectively attached to the handles 12, and the bottom of the tray 1, capable of reducing slipperiness of the handles 12 and the bottom; the rubbers 111 are preferably formed to stick out from the main body of the serving tray 1 with a height ranging from 0.2 mm to 0.5 mm so that the rubbers 111 can provide enough slip-preventing function while smoothness of the holding portion is maintained; the short tube 151 is cut out of the tray 1 after the injection process is finished.

Figure 7:
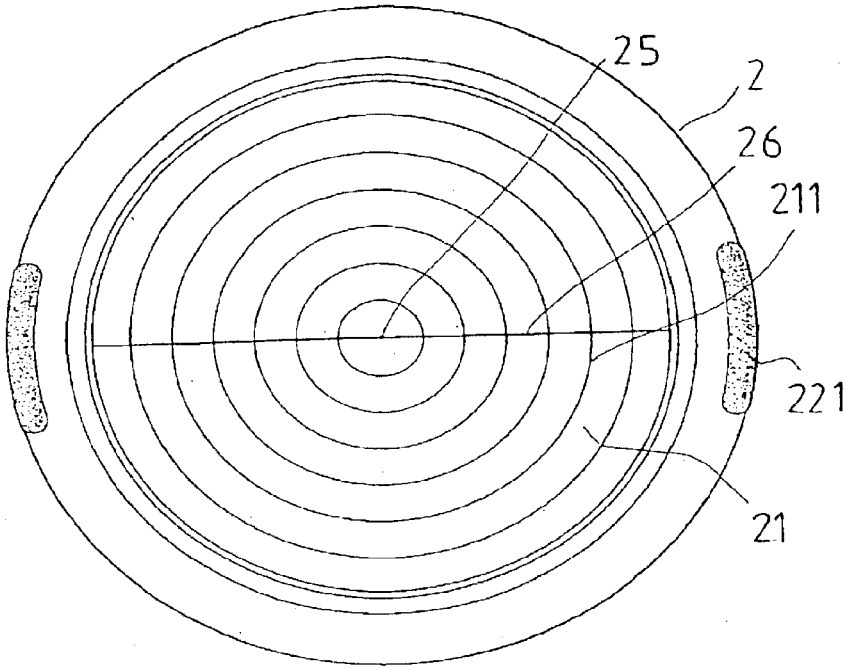
FIG. 7 is a bottom view of the serving tray of the second embodiment.
Figure 6:
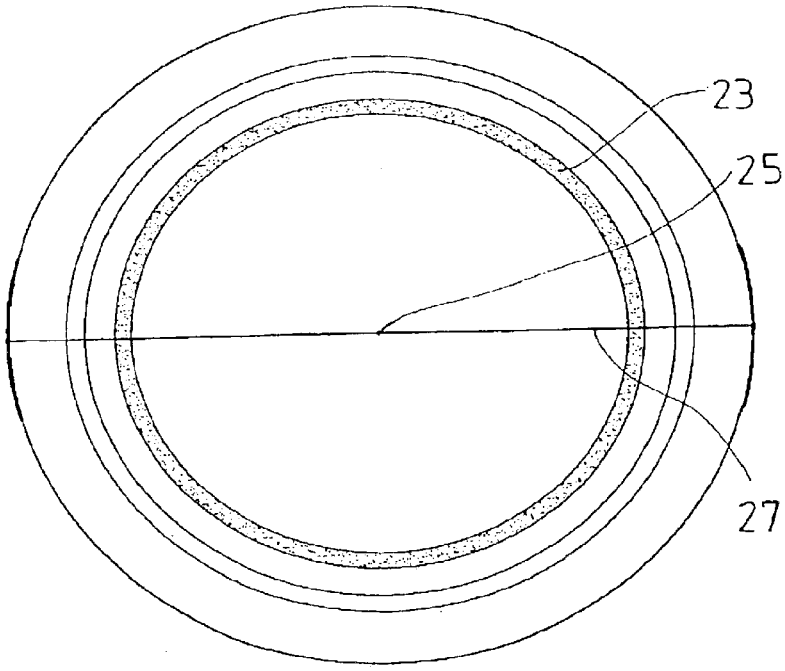
FIG. 6 is a vertical view of the serving tray of the second embodiment.

Referring to FIGS. 6, and 7, a serving tray 2 of the second embodiment is formed with a through hole 25, upper side and lower side flow passages 26, 27, circular trenches (not numbered) on the upper, and the lower sides thereof, and recesses (not numbered) on the edges; thus, circular slip-prevention rubbers 211, 23 can be attached to the upper and the lower sides, and slip-prevention rubber sheets 221 can be attached to the edges with the bicolor injection molding machine.

Figure 8:
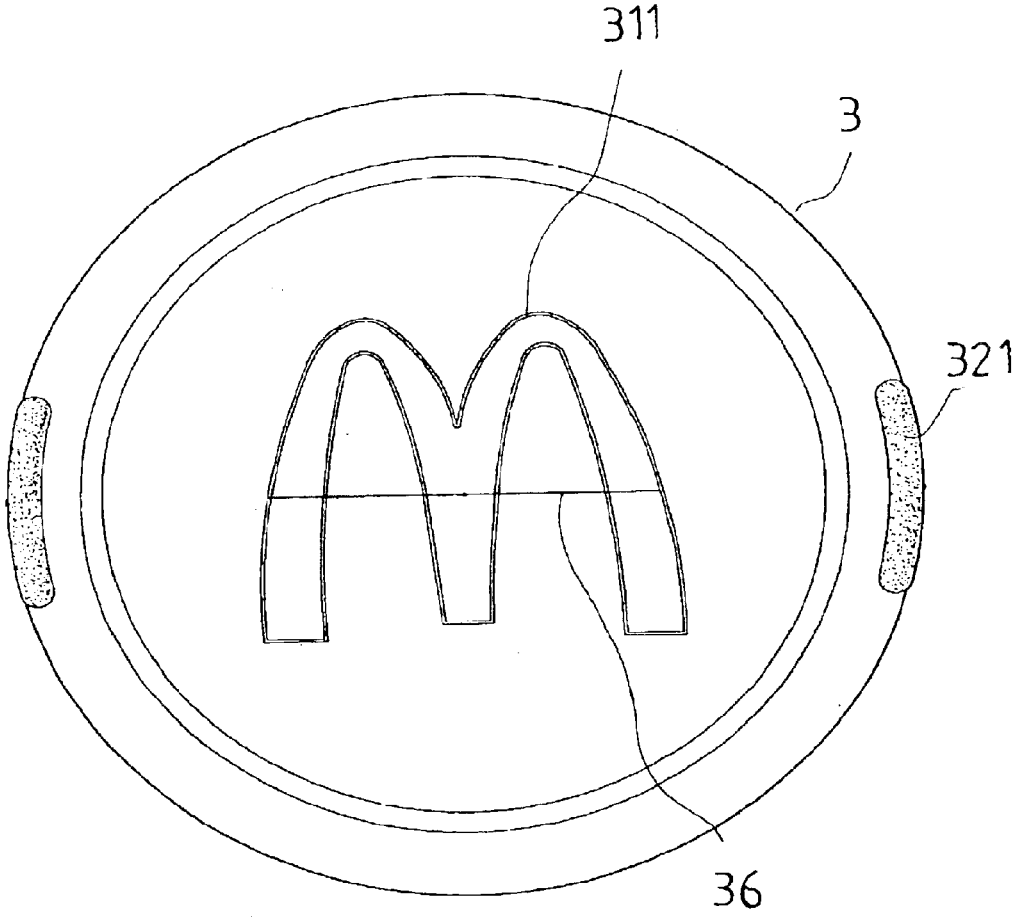
FIG. 8 is a vertical view of the serving tray of the third embodiment; and, FIG. 9 is an exploded perspective view of the conventional serving tray as described in the Background.

Referring to FIG. 8, according to the third embodiment, a serving tray 3 is formed with trenches, which can be in the form of various designs, trademarks or symbols so that when rubber is applied over them, the rubber can form slip-prevention rubbers 311 of the same shape. And, the rubbers 311 are different colors from the tray 3. Thus, the serving tray 3 is more attractive and fancy.

From the above description, it can be easily understood that the serving trays of the present invention have advantages as followings:

1. Slip-prevention means made according to the present invention are of relatively low material cost when compared with those of the prior art serving tray because there is less rubber material used, which is relatively expensive as compared with plastic. Consequently, serving trays of the present invention are more economical to use.
2. The slip-prevention rubber sheets are attached to the serving trays by means of the same bicolor injection molding machine right after the serving trays are formed and harden instead of by means of adhesive. Therefore, the slip-prevention rubber sheets can't easily fall off the serving trays even after the serving trays have been used for a long period. And, the slip-prevention rubber sheets make the serving trays more attractive and fancy.

What is claimed is:

1. A serving tray, comprising a holding portion having a plurality of trenches formed on an upper side thereof, and a plurality of first recesses formed on a bottom thereof; the holding portion having a through hole, upper flow passages formed on the upper side and in communication with the through hole as well as the trenches, and lower flow passages formed on the bottom and in communication with the through hole as well as the first recesses;

handles at two opposite edges thereof; the handles having second recesses formed thereon and in communication with the lower flow passages; and, slip-prevention rubber sheets attached to the trenches and the recesses; the rubber sheets being formed by means of injecting melted rubber into a mold, which is used for making the holding portion and the handles, via the through hole for the melted rubber to be applied over the trenches, and the recesses via the upper and the lower flow passages.

2. The serving tray as claimed in claim 1, wherein the trenches are in a form of trademarks.

3. The serving tray as claimed in claim 1, wherein the slip-prevention rubber sheets stick out from respective sides of the holding portion and the handles with a height ranging from 0.2 mm to 0.5 mm.

* * * * *